US005379909A

United States Patent [19]

Roark

[11] Patent Number: 5,379,909

[45] Date of Patent: Jan. 10, 1995

[54] FILLABLE HAND HELD EXERCISE DEVICE COMPRISED OF ONE DUAL SIDED CLOSURE AND AT LEAST ONE CONTAINER

[76] Inventor: Carlton Roark, 5580 La Jolla Blvd. #300, La Jolla, Calif. 92037

[21] Appl. No.: 946,010

[22] Filed: Sep. 15, 1992

Related U.S. Application Data

[63] Continuation-in-part of Ser. No. 632,419, Dec. 24, 1990, abandoned, which is a continuation-in-part of Ser. No. 465,791, Jan. 16, 1990, abandoned.

[51] Int. Cl.[6] ..... B65D 41/00; A63B 21/00

[52] U.S. Cl. ..... 215/329; 215/6; 215/10; 215/100 R; 220/756; 482/108

[58] Field of Search ..... 215/6, 10, 100 R, 329; 482/106, 108; 220/756

[56] References Cited

U.S. PATENT DOCUMENTS

| | | | |
|---|---|---|---|
| D. 337,522 | 7/1993 | Kingsbury | D9/307 X |
| 2,110,237 | 3/1938 | Parsons | 215/6 X |
| 2,326,414 | 8/1943 | Thompson | 215/6 X |
| 2,833,436 | 5/1958 | Ruderian | 215/6 |
| 2,884,148 | 4/1959 | Schneider et al. | 215/6 |
| 3,311,374 | 3/1967 | Wittenberg et al. | 482/106 |
| 4,076,236 | 2/1978 | Ionel | 482/108 |
| 4,361,324 | 11/1982 | Baroi | 482/108 |

*Primary Examiner*—Allan N. Shoap
*Assistant Examiner*—Nova Stucker

[57] ABSTRACT

A dual sided closure comprising a divider wall at its interior midsection, in combination with at least one substantially cylindrical container comprising a substantially centered and substantially cylindrical neck portion with said neck portion further comprising an external surface diameter substantially identical to the external surface diameter of the dual sided closure, whereby the attachment of a second and substantially identical container will assemble to resemble, and function as, a fillable dumbbell exercise device.

3 Claims, 3 Drawing Sheets

42
38
34

30
25
26
22
20
24
23

28
32
36
40
12
14
13
16

18
10
11

42
38
34
30
25
26
22
16
12
14
13
18
11
10
14
20
23
24
28
32
36
40

FILLABLE HAND HELD EXERCISE DEVICE COMPRISED OF ONE DUAL SIDED CLOSURE AND AT LEAST ONE CONTAINER

This is a continuation-in-part of application Ser. No. 07/632,419 filed Dec. 24, 1990 now abandoned, which is a continuation-in-part of application Ser. No. 07/465,791 filed Jan. 16,1990, now abandoned.

BACKGROUND OF THE INVENTION

The present invention relates to hand held exercise devices, specifically to an improved fillable hand held exercise device.

Heretofore, the sole purpose of consumer goods containers and their closures has been to contain,package, store and/or display their original contents, after which they are then promptly thrown out. At most, some have had a static second life use as storage receptacles, decorative decanters, or flower vases. But very seldom do we find containers and their closures specifically designed for a novel, dynamic and functional second life use, more specifically, a fillable hand held exercise device. Although many different types of fillable hand held exercise devices are known to exist, none suggest the transition from, or similarity with, any container and dual sided closure combination, or vice versa, nor does any container and dual sided closure, or fillable hand held exercise device suggest the unique features necessary to effect such a transition or similarity.

The most common fillable dumbbell product now known to exist is simply comprised of a one piece cylindrical container with a slightly narrower midsection for gripping, and a closure at the top. This type of fillable dumbbell is characterized by bells/chambers just slightly larger in circumference than its grip area because of the blow molding limitations imposed by that design, and necessitates having bells/chambers too small to adequately weight when filled with water.

SUMMARY OF THE INVENTION

The primary object of the present invention is to provide a fillable dumbbell with bells/chambers large enough to be adequately weighted when filled with water. This is accomplished by first blow molding each end of the fillable dumbbell separately as a bottle and then assembling them to each end of the dual sided closure.

Another object of the present invention is to provide a dual sided closure and container comprising those certain characteristics that will permit their subsequent assembly into a fillable hand held exercise device resembling a standard type dumbbell.

According to the invention, these objects are achieved when a dual sided closure and container are characterized by the following four characteristics in combination; (1) A dual sided closure comprising an internally threaded bore and a transverse dividing wall positioned perpendicularly along its central longitudinal axis within its interior midsection and (2) a one piece container comprising a substantially centered neck with (3) the dual sided closure and container being substantially cylindrical whereby (4) the outer surface of closure and container neck are of substantially equal outer surface diameter.

The synergy of these four characteristics in combination provides more than simply a fillable hand held exercise device comprised of two containers and a dual sided closure (characteristic 1) intended to resemble a standard dumbbell when fully assembled. This synergy also provides a substantially centered container neck and a substantially cylindrical shape for the dual-sided closure and container (characteristics 2 and 3) that further serve to assure that the two substantially similar containers line up in a level, balanced and symmetrical manner when fastened to each end of the dual-sided closure. Still further, characteristic 4 above assures that the dual-sided closure and container neck, that are intended to comprise the grip area of the fillable dumbbell when fully assembled, are of substantially equal outer surface diameter, similar again to a standard dumbbell, in order to be gripped comfortably in ones hand. Furthermore, the dual sided closures overlapping of each containers neck serves to reinforce the strength and rigidity of this section comprising the grip area normally subject to stress from the weight exerted by the fillable bells/chambers on both ends.

The present invention is also environmentally advantageous because it extends the overall useful life for containers and their closures that would have otherwise contributed to the waste and landfill crisis.

Still another advantage of the present invention is to provide consumers with a valuable exercise device at the lowest possible cost, specifically as a by-product of consumer goods packaging. In its initial capacity as a consumer goods container, the present invention additionally possesses significant marketing and sales promotion advantages due to its "repeat purchase inducing" characteristics. This is caused by a consumers need to purchase four containers of product in every size they wish to eventually assemble into a pair of fillable dumbbells.

DRAWING FIGURES

FIG. 1 is the preferred embodiment of the present inventions dual sided closure and discloses a half sectional view FIG. 2*a* and 2*b* is the preferred embodiment of the present inventions one piece container and discloses a side view.

FIG. 3 is an alternative embodiment and half sectional view of the present inventions dual sided closure.

FIG. 4*a* and 4*b* is an alternative embodiment and side view of the present inventions one piece container.

FIG. 5 is another alternative embodiment and half sectional view of the present inventions dual sided closure.

FIG. 6*a* and 6*b* is another alternative embodiment and side view of the present inventions one piece container.

REFERENCE NUMERALS IN DRAWINGS

10 and 12 dual sided closures internally threaded fastening ends

11 and 13 sealing discs on each side of divider wall

14 divider wall

16 and 18 substantially cylindrical outer surface of dual sided closure

20 and 22 container mouth or opening

23 and 25 annular ledge between the first and second neck portions

24 and 26 externally threaded second neck portion of container

28 and 30 first neck portion of container

32 and 34 transition portion and top wall of container

36 and 38 enclosed side wall of container 40 and 42 base of container

DESCRIPTION OF DRAWINGS

FIG. 1 is a half sectional side view of the dual sided closure and discloses a sleeve having a substantially uniform and substantially cylindrical external surface 16 and 18 along its entire length. The interior of the closure sleeve comprises a midpoint and a central longitudinal axis with a divider wall 14 positioned perpendicularly to said longitudinal axis separating the interior of the sleeve into two substantially identical bore portions 10 and 12, with each bore portion comprising a substantially identically internally threaded fastening means and being threadably attachable to containers FIG. 2*a* and FIG. 2*b* of the present invention. On each side of divider wall 14 is a sealing disc 11 and 13 comprised of a yieldable, coated or uncoated, plastic, paper or rubber material, to ensure a fluid tight seal between each end of the dual sided closure and the container it is fastened to. FIG. 2*a* and FIG. 2*b* each illustrate a side view of the preferred embodiment for the substantially identical containers of the present invention. Containers in FIG. 2*a* and FIG. 2*b* each comprise a base portion 40 and 42 with an enclosed side wall 36 and 38 extending upwardly from the base portions 40 and 42. Above enclosed side walls 36 and 38 is a transition portion 32 and 34 comprising a top wall extending radially inwardly to the first substantially cylindrical neck portions 28 and 30 which are substantially centered above the enclosed side wall 36 and 38 and transition portion 32 and 34. The substantially cylindrical first neck portions 28 and 30 comprise a substantially uniform length and outer surface and further comprise a circumference substantially less than the substantially cylindrical perimeter of the enclosed side wall 36 and 38, First neck portions 28 and 30 additionally comprise a diameter substantially identical to that of the external surface 16 and 18 of the closure of FIG. 1. A second neck portion 24 and 26 extends from first neck portions 28 and 30, with second neck portions 24 and 26 further comprising an externally threaded annular sleeve. The outer surface of said externally threaded annular sleeve of second neck portions 24 and 26 being spaced from outer surface of first neck portions 28 and 30 so as to form an annular ledge 23 and 25 between the first neck portions 28 and 30 and second neck portions 24 and 26. The containers of FIG. 2*a* and FIG. 2*b* each comprise a container mouth or opening 20 and 22 having a diameter at least large enough for a penny to pass through. The closure and containers of FIG. 1, 2*a*, and 2*b* respectively are comprised of a plasticized material, preferably rigid and recyclable such as High Density Polyethelene (HDPE) or Polyethelene Terephthalate (PET).

Figures 3, 4A, 4B:
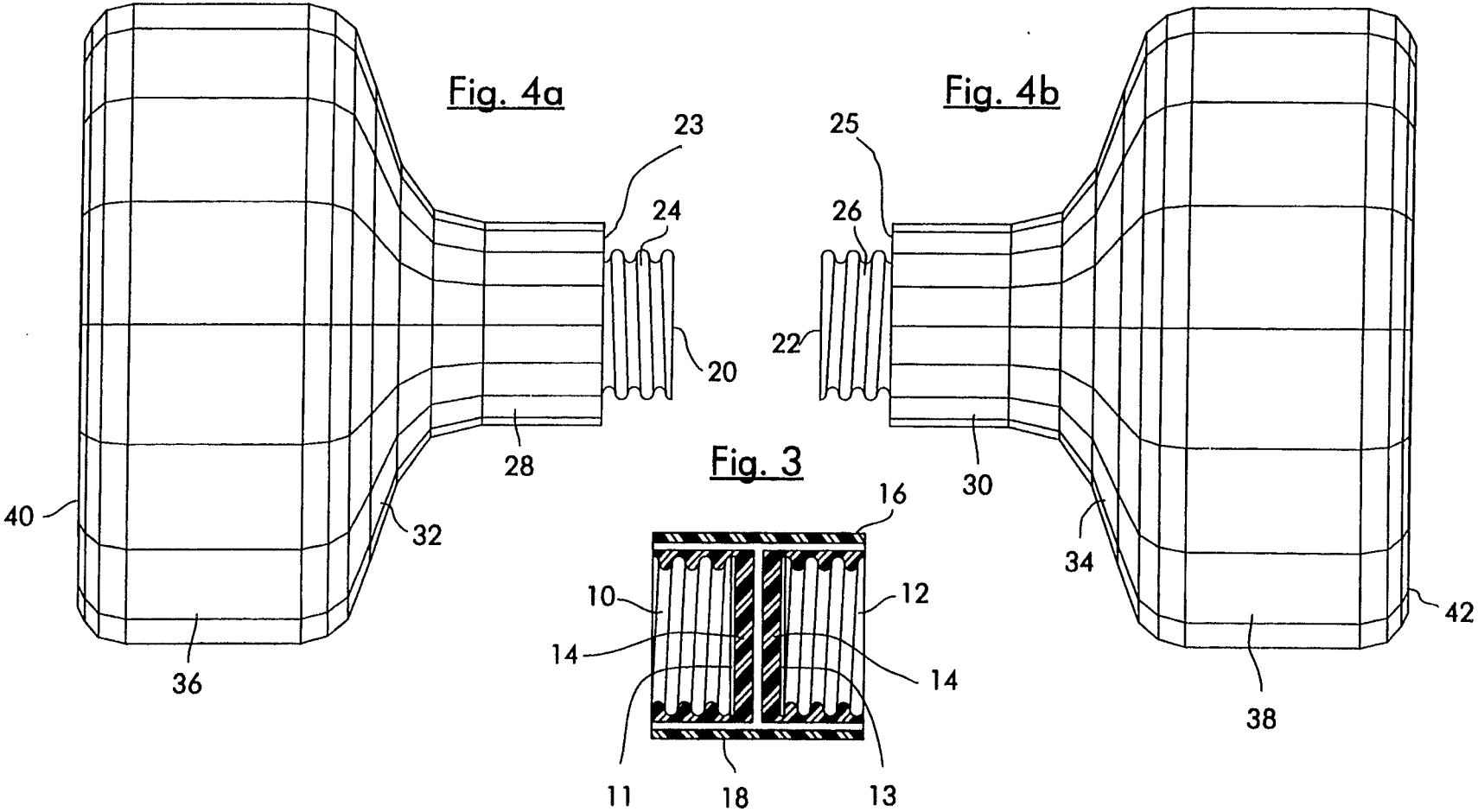

An alternative embodiment for the present invention is illustrated in FIG. 3, 4*a*, and 4*b*. The closure in FIG. 3*a* of this alternative embodiment discloses a half sectional side view whereby two standard type closures of a certain total length can be snugly inserted back to back into a hollow bore or cylindrical sleeve of similar total length as that of tile two standard type closures positioned back to back. This closure in FIG. 3 of this alternative embodiment of the present invention would be used with its corresponding alternative embodiment containers FIG. 4*a* and FIG. 4*b* that comprise a recessed annular ledge sufficient to allow the closure of FIG. 3 to be threadably attached and still have an exterior surface whose diameter is substantially similar to the first neck portions 28 and 30 of the containers in FIG. 4*a* and FIG. 4*b* of the alternative embodiment of the present invention.

Figures 5, 6A, 6B:
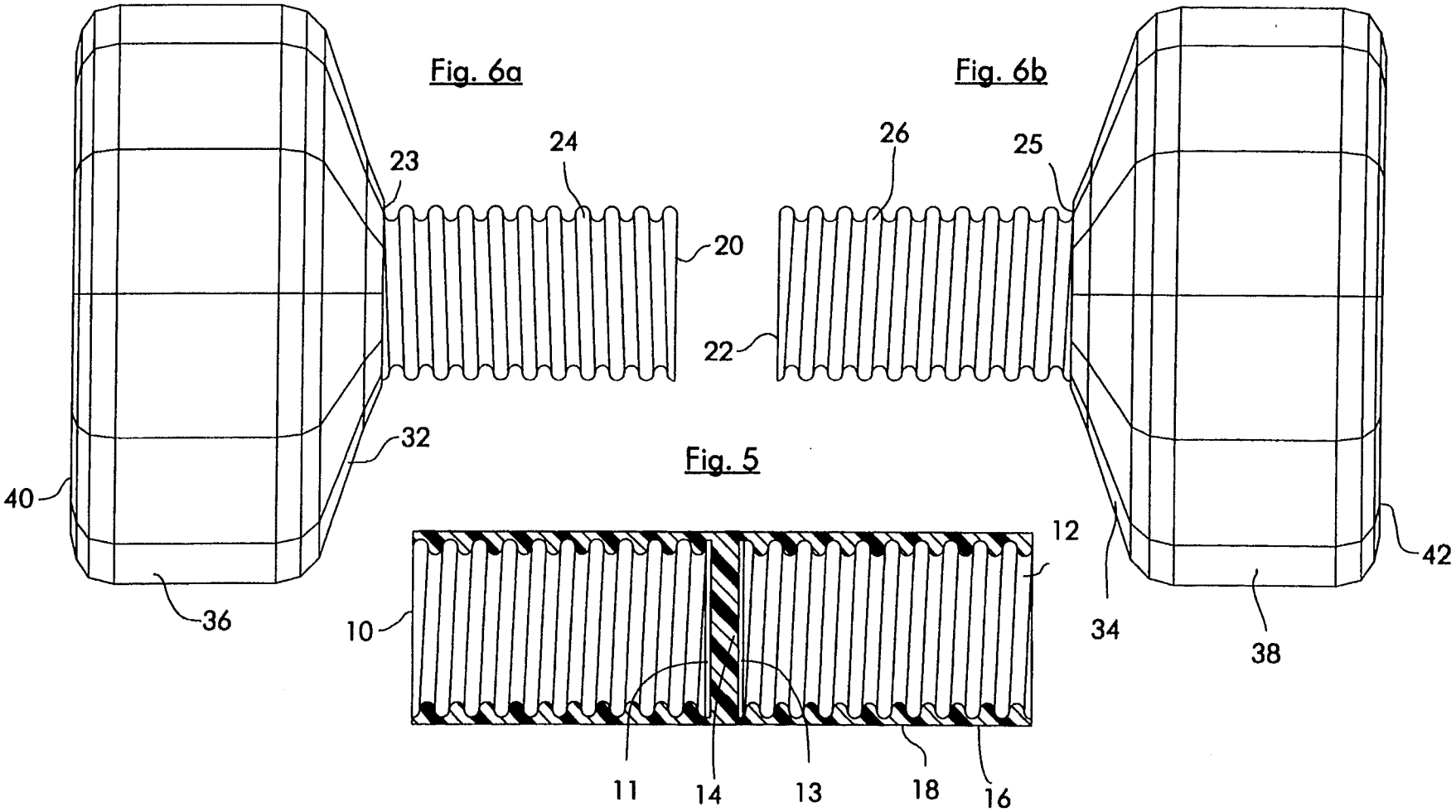

Another alternative embodiment for the present invention is illustrated in FIG. 5, 6*a* and 6*b*. The closure in FIG. 5 of this additional alternative embodiment discloses a half sectional side view whereby the closure FIG. 5 is of sufficient length to be threadably attached to the entire externally threaded annular sleeve of the merged first and second neck portions 24 and 26 on containers in FIG. 6*a* and FIG. 6*b* of this additional alternative embodiment of the present invention. The containers of FIG. 6*a* and FIG. 6*b* of this additional alternative embodiment disclose a first neck portion and a second neck portion 24 and 26 that are the same. In other words, all or a portion of the second neck portions 24 and 26 could comprise all or a portion of the first neck portion.

The preferred and alternative embodiments of the present invention can comprise a plurality of colors and material compositions, recyclable or not. In addition, all embodiments of the present invention can comprise a variety of fastening systems sufficient to accomplish the intentions of the present invention. All embodiments of container for the present invention are formed as a one piece unit with rounded corners, except at the annular ledge between the first and second neck portions, to allow for the injection blow mold manufacturing process. Moreover, the substantially uniform and substantially cylindrical outer surface for all embodiments of, containers enclosed side wall, dual sided closure, and first neck portions of the present invention further include use of faceted surfaces, hexagon shapes, etc., and may further include other non-slip surfaces such as grooved exteriors, etc. Therefore, substantially cylindrical and substantially uniform is defined herein to additionally include the use of faceted or grooved non-slip surfaces, for all embodiments of the present invention.

Figures 1, 2A, 2B:
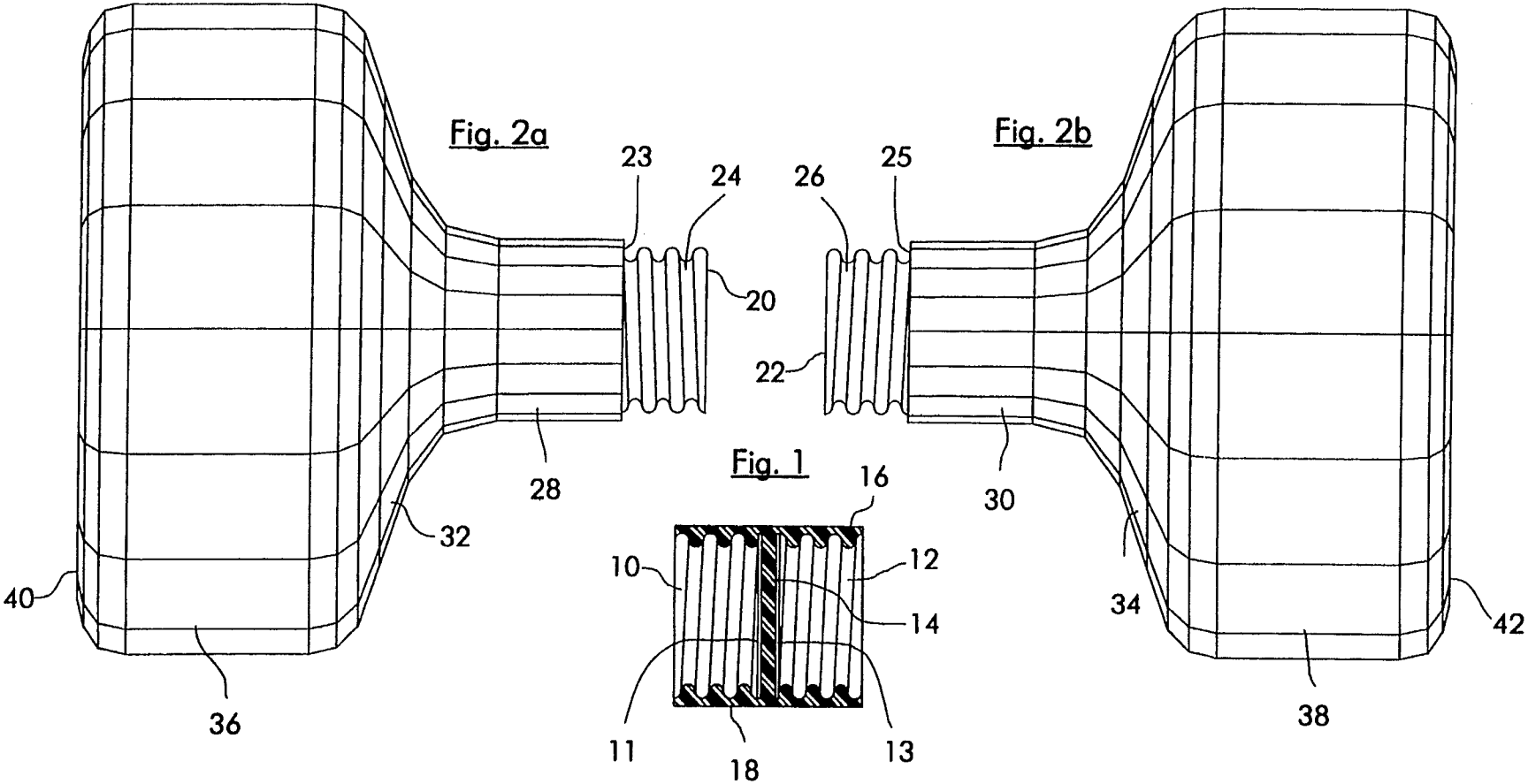
FIGS. 1,2*a* and 2*b* illustrate the preferred embodiment for the dual sided closure and container combination of the present invention.

OPERATION—FIGS. 1,2*a*, and 2*b*

The preferred embodiment of the present invention will presumably begin its life as simply a particular size of bottlenecked container FIG. 2*a* of some consumer product in fluid, powder, tablet, granule, flake or other form, except that this bottlenecked container will incorporate the unique dual sided closure in FIG. 1. Consumers would then be required to eventually purchase another container FIG. 2*b* of product of substantially similar size in order to subsequently deplete and rinse the containers in FIG. 2*a* and FIG. 2*b* of their original contents and have them refilled with water, sand, pennies or other material suitable for weighting, and assembled. To assemble, the container in FIG. 2*a* is cleaned and rinsed of its original contents and refilled through the container mouth or opening 20. One end 10 of the dual sided closure of FIG. 1 is then placed onto the externally threaded fastening means 24 of the container in FIG. 2*a* and is threadably attached by turning the dual sided closure of FIG. 1 in a clockwise direction until firmly fastened. Another container FIG. 2*b* of substantially similar size and shape is then filled through container mouth or opening 22 in similar manner as was the container of FIG. 2*a*. One then takes the now filled container of FIG. 2*a* with the dual sided closure of FIG. 1 firmly attached and inverts them so that the remaining and unattached end 12 of the dual sided closure of FIG. 1 can be lowered onto the externally threaded fastening means 26 of the other substantially identical container of FIG. *2b*. The closure end 12 of FIG. 1 with opposite end 10 already fastened to the container of FIG. *2a* is then threadably attached in a clockwise direction to the externally threaded fastening means 26 of the container of FIG. *2b* until tightly fastened. Fully filled and assembled, this combination of dual sided closure in Fig. I and the two containers in FIG. *2a* and FIG. *2b* now become weighted and configured to resemble and function as a fillable hand held exercise device generally referred to as a dumbbell. By gripping the area comprising the dual sided closure of FIG. 1 and lifting its fillable weight against the force of gravity, one is able to perform a variety of exercise routines and thus exert muscular tension to various areas of the body.

Moreover, the containers in FIG. *2a* and FIG. *2b* can have their fillable contents varied, or emptied altogether for shipping and traveling where the extra weight would otherwise be a detriment. Furthermore, none of the embodiments of the present invention require begining their product life cycles as containers of some consumer product. Instead, these embodiments may function initially and solely thereafter as simply fillable hand held exercise devices.

I claim:

1. A container and closure in combination, said container comprising a base portion with an enclosed side wall extending upwardly from said base portion, a substantially cylindrical first neck portion having a substantially uniform outer surface along its entire length extending upwardly from a transition portion, said transition portion comprising a top wall extending radially inwardly to said first neck portion, said enclosed side wall comprising a perimeter substantially larger than the circumference of said first neck portion, said first neck portion being substantially centered above the enclosed side wall and transition portion, said container narrowing from said transition portion to said first neck portion, a second neck portion extending from said first neck portion, said second neck portion comprising an externally threaded annular sleeve, the outer surface of said externally threaded annular sleeve being spaced radially inwardly from said outer surface of said first neck portion so as to form an annular ledge between said first and second neck portions, said container being formed as a one piece unit;

said closure comprising a sleeve having a substantially uniform and substantially cylindrical external surface along its entire length, the closure sleeve having an interior, the length of said interior having a midpoint, said closure sleeve having a central longitudinal axis, said closure sleeve further comprising a transverse dividing wall at the interior midpoint, said dividing wall positioned perpindicularly to said central longitudinal axis, said dividing wall separating the interior of the sleeve into two substantially identical bore portions, each bore portion being substantially identically internally threaded and threadably attachable to said second neck portion, said closure sleeve being bounded by opposed ends, said closure external surface having substantially the same diameter as said first neck portion, said closure sleeve and each internally threaded bore of the closure comprising a length such that when one of said internally threaded bores is secured to said externally threaded annular sleeve of said second neck portion of said container, said closure and said first neck portion presents a substantially cylindrical handle having a substantially uniform cross section except for any gap that may exist between said ledge and a respective end of said closure sleeve, the other of said internally threaded bores being provided for attachment in the same manner to a substantially identical container.

2. The closure of claim 1 wherein said transverse dividing wall includes a sealing disc on each side of said dividing wall.

3. The container of claim 1 wherein said enclosed side wall is substantially cylindrical.

* * * * *